United States Patent [19]

Deyama et al.

[11] Patent Number: 4,760,310

[45] Date of Patent: Jul. 26, 1988

[54] CATHODE-RAY TUBES AND COATING MATERIALS THEREFOR

[75] Inventors: Sadao Deyama; Toshiya Yamamoto, both of Matsudo; Koichi Sakai, Tokyo; Shigemi Hirasawa, Chiba; Tadao Kubo; Yoshifumi Tomita, both of Mobara, all of Japan

[73] Assignees: Hitachi Powdered Metals Co., Ltd.; Hitachi, Ltd., both of Japan

[21] Appl. No.: 821,269

[22] Filed: Jan. 21, 1986

[30] Foreign Application Priority Data

Jan. 31, 1985 [JP] Japan ..... 60-17641
Jan. 31, 1985 [JP] Japan ..... 60-17642

[51] Int. Cl.[4] ..... H01J 29/88; H01J 29/92
[52] U.S. Cl. ..... 313/479; 313/477 HC
[58] Field of Search ..... 313/479, 450, 477 R, 313/477 HC, 480

[56] References Cited

U.S. PATENT DOCUMENTS

| | | | |
|---|---|---|---|
| 3,791,546 | 2/1974 | Maley et al. | 313/479 X |
| 4,153,857 | 5/1979 | Delsing et al. | 313/479 X |
| 4,379,762 | 4/1983 | Chiyoda et al. | 313/479 X |
| 4,602,187 | 7/1986 | Fischman et al. | 313/479 |

FOREIGN PATENT DOCUMENTS

| | | | |
|---|---|---|---|
| 1010 | 1/1980 | Japan | 313/479 |
| 151754 | 11/1980 | Japan | 313/479 |
| 150539 | 11/1980 | Japan | 313/479 |

*Primary Examiner*—Palmer C. DeMeo
*Attorney, Agent, or Firm*—McGlew and Tuttle

[57] ABSTRACT

A cathode-ray tube is coated on the inner surface with a coating material which contains, in a weight ratio based on solid, 10 to 22% of graphite, 30 to 50% of a metal oxide, 2 to 9% of a surface treating agent and 25 to 42% of water glass, and in which at least 18% of graphite powders in its simplest form suspended in said coating material have a particle size of at least 1 micron.

3 Claims, 2 Drawing Sheets

CATHODE-RAY TUBES AND COATING MATERIALS THEREFOR

FIELD OF THE INVENTION

The present invention generally relates to a cathode-ray tube and a coating material to be applied to the inner face or inside thereof. More specifically, the present invention pertains to a novel cathode-ray tube for eliminating various problems associated with sparking by affording a specific property to an electrically conductive coating film applied on the inside thereof, thereby limiting or reducing the value of a spark current, and to a coating material for forming such a coating film.

BACKGROUND OF THE INVENTION

Before discussing in detail the present invention, reference will be made to the general aspect of a cathode ray tube. As shown in FIG. 1, the cathode-ray tube generally includes an envelope or a body made of a glass material, which comprises a neck portion 1, a conical portion 2 integrated thereto, and a display portion 3.

The conical portion 2 is provided on the outer surface with an electrically conductive, outer coating film 6 and on the inner surface with an electrically conductive, inner coating film 5, which is contiguous to a high-voltage conductor 4 adapted to be applied with a high-voltage potential. The outer coating film is, on the other hand, at earth potential.

Such coating films may usually be obtained from a coating material prepared by dispersing a metal oxide such as titanium oxide and graphite in an aqueous solution of an alkali metal silicate such as water glass.

An electron gun 7 is accommodated within the neck portion 7 with contactor 8 being in contact with the inner coating film 5. Reference numeral 9 stands for a shadow mask.

Incidentally, it is substantially unavoidable that a slight amount of the inner coating film peels off in the form of fine pieces during the production process and later handling of cathode-ray tubes, e.g., due to friction with the contactor 8 at the time of mounting of the electron gun. Since a voltage of ten plus several KV or higher is usually applied on the electron gun while the cathode-ray tube works in good order, a short circuit takes place between the electrodes of the electron gun 7 by those fine pieces, thereby giving rise to a spark current reaching as high as 500 Å.

Such a current flows in an electronic circuit connected to the cathode-ray tube by way of induction coupling or capacity coupling, thus giving damage to semiconductor parts having a low resistance to voltage, insulating parts, etc., or the electrodes per se of the electron gun. Practically, a spark current exceeding 200 Å is taken as being hihgly dangerous.

To avoid such a short-circuit accident, it has been proposed to increase the resistance of the coating film to a high value of 1MΩ to 100MΩ, as disclosed in U.S. Pat. Nos. 2,545,120 and 2,829,292. However, such a proposal is found not to be suitable for currently available production systems. This is because the production process involves a step for applying a voltage higher than designed on the electrodes for sparking at an initial stage. If the resistance of the coating film is higher than 100 KΩ, then breakage of the insulation applied on the cathode-ray tube takes place, so that small holes are instantaneously formed in the wall thereof.

There have also been various proposals directed to the limitation of specific resistance values of the coating film, i.e., static and dynamic resistance values (see Japanese Patent Publication No. 58-32735), the method of preparing resistant coating materials (see Japanese Patent Publication No. 53-9400), etc.

However, it has been found that such proposals do not give satisfactory results, or involve some practical difficulties.

As a result of intensive studies made of a number of factors attributable to the problems as mentioned in the foregoing, the following significant facts have been found.

More specifically, if the inner coating film to be applied meets the following two requirements, (1) the coating film having a specific resistance of at least 0.2 ohm.cm, and (2) the coating film having a surface roughness of at least 6 microns, then a spark current occurring at the time of a short circuit is limited to 200 Å or lower, even when the resistance value between the electron gun 7 and the high-voltage conductor 4 is of a relatively low value of at least about 2 KΩ. The foregoing underlies the present invention.

SUMMARY OF THE INVENTION

According to one aspect of the present invention, there is provided a novel cathode-ray tube wherein an inner coating film has a specific resistance of at least 0.2 Ω.cm and a surface roughness of at least 6 microns, and wherein a resistance value between a high-voltage conductor and an electron gun is in a range of 2 to 100 KΩ.

According to another aspect of the present invention, there is provided a novel inner coating material containing, in a weight ratio based on solid, 10 to 22% of graphite, 30 to 50% of a metal oxide, 2 to 9% of a surface treating agent and 25 to 42% of water glass, characterized in that graphite powders are suspended in its simple form in contrast to the rest of the graphite which forms a composite granulated powder with metal oxide and the surface treating agent, in the coating material have a particle size of at least 1 micron.

Other features and advantages provided by the present invention will become apparent from the ensuing detailed description of the invention's presently preferred embodiment.

DETAILED DESCRIPTION OF THE PREFERRED EMBODIMENTS

Figure 1:
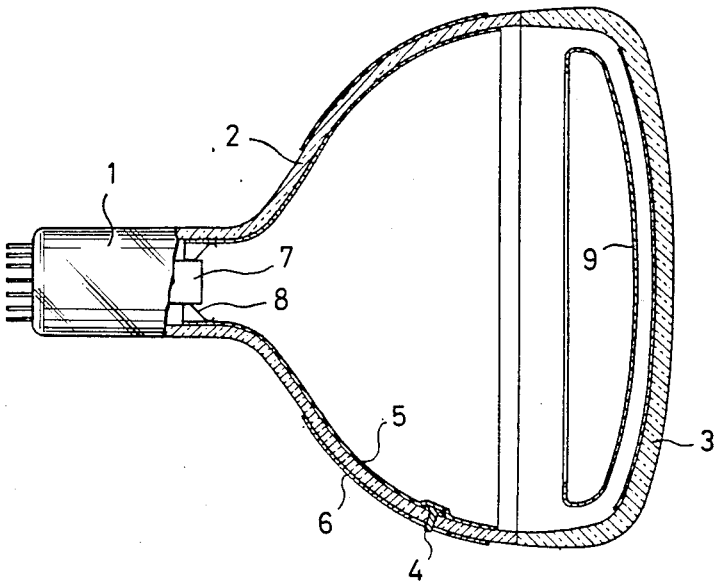
FIG. 1 is a sectional view showing the general structure of a cathode-ray tube.

The present invention will now be explained in detail with reference to the preferred embodiment and the comparison examples given for the purpose of comparison alone. In general, an electrically conductive coating film to be applied to the inside of a cathode-ray tube is formed with the use of a coating material obtained by dispersing graphite, a metal oxide and a surface treating agent in an aqueous solution of water glass or other alkali metal silicate. Thereupon, a coating material for testing was prepared.

First of all, powdery titanium dioxide serving as the metal oxide and colloidal silicon dioxide serving as the surface treating agent were formulated with powdery graphite in the proportion as specified in the column "granular form" in Table 1, and the resulting formulation was fully mixed together in water, and was then subjected to spray drying to obtain a composite granulated powder.

The thus granulated powder was then formulated with powdery graphite (having different particle sizes, as specified in Table 2, the left column) and water glass in the weights as specified in the column "granular form" in Table 1. From the obtained formulations, the coating materials for testing were prepared, using as the dispersion medium water containing 1% of a dispersant.

Coating of the coating materials is usually achieved by flow coating, brush coating, dip coating, spray coating and the like, and the concentration of the coating materials is adjusted in such a manner that a given viscosity is reached depending upon the particular method applied. In the present invention, flow coating was applied.

It should be understood that the reason why a part of the coating material's components is used in the form of a composite powder is to enhance the dispersion stability of various components, in particular the metal oxide, thereby extending the pot life of the product after formulation and hence making it suitable for the mass production of cathode-ray tubes. Subsequent to the addition of the composite, granulated powder graphite in its simplest form is added. If the coating material is made of the composite granulated powder and the waterglass only, the resistance value of the film formed by the coating material will vary greatly and thus make it difficult to control the resistance value within the required range. Therefore, a part of the graphite in its simplest form is added to regulate the resistance value. This is done by first keeping the resistance at a value higher than the value to be controlled with the composite granulated powder and the waterglass, and then the graphite in its simplest form is added to gradually lower the resistance value so as to bring it within the range control. Furthermore, in addition to the graphite in its simplest form, if a graphite having a particle size of less than 1 micron is used, the surface roughness of the coating film will be too small and will not meet the objects of the present invention. It should be noted, therefore, that simultaneous formulation of all the components has no particular adverse influence upon the properties of the coating film even on an experimental scale. Forming no part of the subject matter of the present invention, the method for preparing the composite powders are not discribed herein. For the details in this respect, see Japanese Patent Publication No. 56-41655.

Each of the thus obtained coating materials was applied on the inner surface of the cathode-ray tube, dried at 50° C. for 30 minutes, and was heat-treated at 430° C. for 60 minutes to form an electrically conductive inner coating film for the following testing.

Each of the thus formed coating films was measured in respect of the surface roughness with a SE-3F type surface roughness meter (diamond feeler having a pointed end of 3 $\mu$R) manufactured by Kosaka Kenkyusho. The results are set forth in Table 2, the right column.

Figure 4:
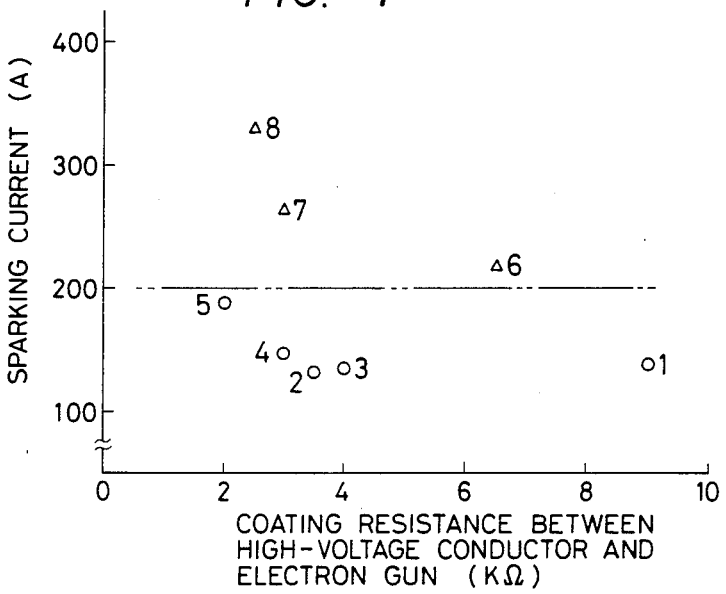
FIG. 4 is a graphical view showing the relation between the spark current and the resistance between the high-voltage conductor and the electron gun.

Measurement was then made of the resistance between the high-voltage conductor and the electron gun of each of the cathode-ray tubes with the built-in electron guns, which had been assembled by the ordinary steps (the resulting data being set forth in FIG. 4). In addition, an instantaneous short-circuit was caused to take place between the electrodes of the electron gun to measure the resulting short-circuit current value, which is designed as the spark current in Table 2.

In order to measure the specific resistance of each of the coating films, each of the coating materials was applied over the entire surface of one side of a glass plate measuring 26 mm×76 mm×1.5 mm, dried at 100° C. for 30 minutes, and was heat-treated at 400° C. for 60 minutes to obtain a sample.

The specific resistance of each sample was determined by measuring the density thereof and the electrical resistance between two point thereon. The results are set forth in Table 2.

Figure 2:
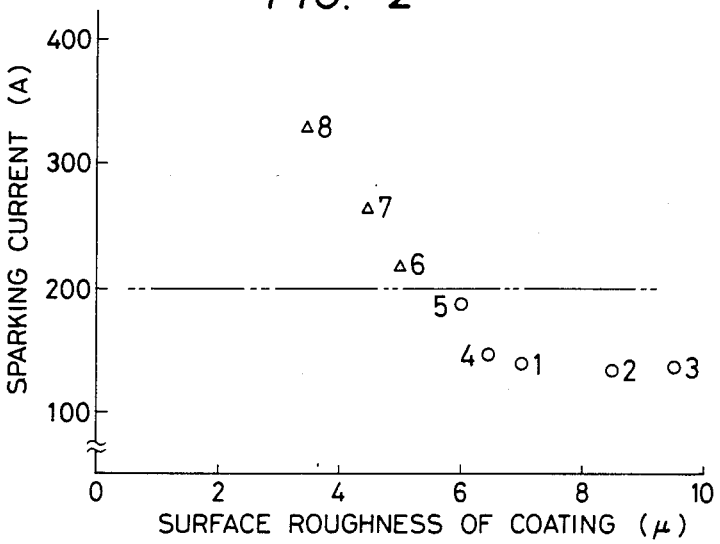
FIG. 2 is a graphical view showing the relation between the spark current and the surface roughness of the inner coating film according to the present invention.
Figure 3:
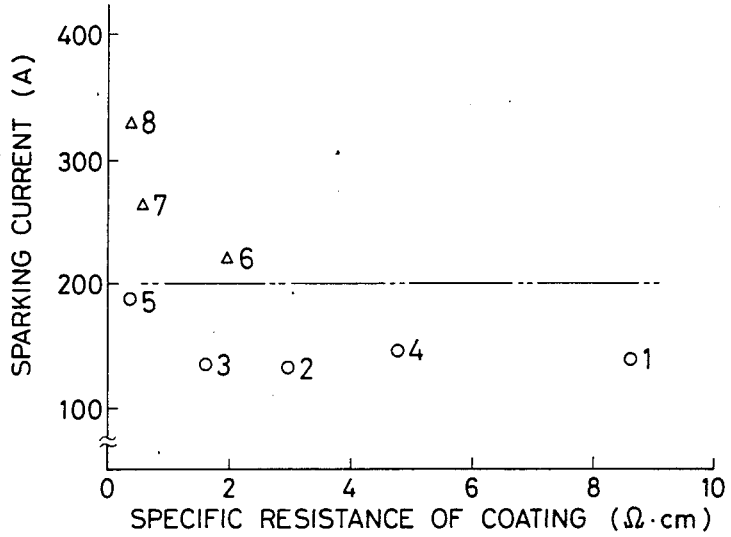
FIG. 3 is a graphical view showing the relation between the spark current and the specific resistance of the inner coating material according to the present invention.

To help consider the experimental results, the graphical views of FIGS. 2 to 4 are obtained by plotting the thus obtained data. In the graphical views, reference numerals 1 to 6 are a serial number standing for the examples of the present invention (O) and the comparison examples (Δ).

As can be seen from FIG. 2 showing the relation between the surface roughness of each coating film and the spark current, the coating film should have a surface roughness of at least 6 microns so as to obtain a spark current of 200 Å or lower.

The following consideration will now be given to the influence of the surface roughness of the inner coating film. The cathode-ray tube was evacuated to vacuum at the final stage of production. Thereafter, a slight amount of remaining gases such as nitrogen, carbon monoxide, methane, water, etc. was removed with the use of a barium getter, while metallic barium was deposited onto the inner coating film. Good results are obtained when the inner coating film had a large surface roughness. However, when the coating film had a surface close to flatness, the metallic barium thus deposited provided a continuous film, resulting in a drop of the resistance thereof. It is then considered that the limit is a surface roughness of 6 microns.

What has a significant influence upon that surface roughness is the particle size of graphite added in the simple form. Between the surface roughness and the content of graphite having a particle size of at least 1 micron there is positive correlation. The method of least squares makes clear that the minimum content of graphite having such a particle size should be 18% so as to maintain a surface roughness of at least 6 microns.

As can be seen from FIG. 3 illustrating the relation between the spark current and the specific resistance of the coating film, the coating film should have a specific resistance of at least about 0.2 ohm.cm so as to obtain a spark current of 200 Å or lower. When the specific resistance of the coating film is below 0.2 ohm.cm, there appears a coating film resistance of below 2 kΩ between the high-voltage conductor and the electron gun. For that reason, a current flows so easily that a spark current is increased at the time of a short-circuit. In Comparison Example 6 wherein the specific resistance of the coating film is within the range defined in the present invention, the reason why the spark current is increased due to the influence of the surface roughness.

FIG. 4 is a graphical view showing the relation between the spark current and the electrical resistance between the high-voltage conductor and the electron gun, and indicating that, as long as the inner coating film meets the requirements (1) and (2) defined in the present invention, a spark current occurring at the time of a short circuit can be limited to a value of 200 Å or lower, even when its resistance has a relatively low value of about 2 to 9 KΩ.

As explained in detail in the foregoing, the coating material according to the present invention provides a coating film satisfying the two requirements that (1) its specific resistance be at least 0.2 ohm.cm and (2) its surface roughness be at least 6 microns.

Referring now to the cathode-ray tube having such a coating material applied on its inner face, the resulting coating film has a resistance limited to a relatively low and pricatical value of at least about 2 KΩ with no fear that its resistance may reach as high as 1MΩ or higher, unlike the prior art. According to the present invention, nonetheless, a spark current occurring at the time of a short circuit can be limited to a low value, resulting in the prevention of the cathode-ray tube and the electronic circuit from malfunctioning in association with sparking.

Preferably, the electrically conductive coating materials used for carrying out the present invention have such compositions as set forth in Examples 1 to 5 of Tables 1 and 2 and, more generally, contain 10 to 22% of graphite, 30 to 50% of a metal oxide, 2 to 9% of a surface treating agent and 25 to 42% of water glass with at least 18% of graphite powders in its simplest form suspended in the coating material having a particle size of at least 1 micron.

In what follows, reference will be made to the action and compositional range of the constitutional components inclusive of graphite, which are general ingredients for electrically conductive coating materials.

GRAPHITE AND METAL OXIDE

Both components have a certain relation to the electrical resistance of the coating film. Graphite serves to decrease the resistance, while the metal oxide serves to increase the resistance. An increase in the content of one leads to a decrease in the content of the other.

Referring to the upper and lower limits of the graphite and metal oxide required to confine the resistance of the coating film within a range of 2 to 100 Ω, the experimental data indicate that, to obtain a resistance of at least 2 KΩ, the graphite should be used in an amount of up to 22%, whereas the metal oxide should be used in an amount of at least 30%, and, to obtain a resistance of up to 100 KΩ, the graphite should be used in an amount of at least 10%, whereas the metal oxide should be used in an amount of up to 50%.

SURFACE TREATING AGENT

The surface treating agent serves to cover the surface of the metal oxide and thereby improve the dispersibility thereof in water glass, and also serves to act as a binder for granulated powder and thereby prevent disintegration of such powders in the coating material. For that reason, that agent should be used in an amount of at least 2%. It should be noted, however, that an excessive amount of the surface treating agent exceeding the upper limit of 9% is caused to exist in the coating material in a free state, and is responsible for cracking of the coating film formed after drying.

WATER GLASS

The water glass functions as a bonding agent for the coating film, peeling-off of which is the greatest problem. To obtain the required strength, the water glass should be used in an amount of at least 25%. When the amount of the water exceeds 42%, however, the coating film is smoother on the surface, and is unpreferred for the reason as mentioned in the foregoing. In addition, an increase in the amount of gases released offers some problems such as a reduction in the service life of the cathode-ray tube, etc.

While the invention has been described with reference to its preferred embodiments, other embodiments can achieve the same results. Variations and modifications of the present invention will be obvious to those skilled in the art and it is intended to cover in the appended claims all such modifications and equivalent as follows in the true spirit and scope of this invention.

TABLE 1

| | Composition of Coating Material (wt % based on solid) | | | | |
|---|---|---|---|---|---|
| | Graphite | | Titanium Dioxide | Silicon Dioxide | |
| NO. | Simple form | Granular form | Granular form | Granular form | Water glass |
| Example 1 | 10.3 | 8.3 | 43.1 | 3.4 | 34.9 |
| Example 2 | 11.9 | 8.1 | 42.3 | 3.4 | 34.3 |
| Example 3 | 14.4 | 7.9 | 41.1 | 3.3 | 33.3 |
| Example 4 | 10.0 | 8.3 | 43.2 | 3.5 | 35.0 |
| Example 5 | 13.1 | 9.0 | 43.8 | 3.5 | 30.5 |
| Comparative Example 6 | 5.5 | 8.7 | 45.4 | 3.6 | 36.8 |
| Comparative Example 7 | 10.3 | 8.3 | 43.1 | 3.4 | 34.9 |
| Comparative Example 8 | 10.3 | 8.3 | 43.1 | 3.4 | 34.9 |

TABLE 2

| | Particle size distribution of simple graphite % | | | Surface | Specific | Spark |
|---|---|---|---|---|---|---|
| No. | More than 1μ | Medium size | Less than 0.2μ | Roughness μ | Resistance Ω cm | Current A |
| Example 1 | 40.4 | 44.0 | 15.6 | 7.0 | 4.3 | 140 |

TABLE 2-continued

| No. | Particle size distribution of simple graphite % More than 1μ | Medium size | Less than 0.2μ | Surface Roughness μ | Specific Resistance Ω cm | Spark Current A |
|---|---|---|---|---|---|---|
| Example 2 | 40.4 | 44.0 | 15.6 | 8.5 | 1.5 | 134 |
| Example 3 | 28.0 | 36.9 | 35.1 | 9.5 | 0.8 | 136 |
| Example 4 | 30.9 | 38.6 | 30.5 | 6.5 | 2.4 | 147 |
| Example 5 | 18.7 | 49.0 | 32.3 | 6.0 | 0.2 | 190 |
| Comparative Example 6 | 1.4 | 21.6 | 77.0 | 5.0 | 1.0 | 220 |
| Comparative Example 7 | 1.4 | 21.6 | 77.0 | 4.5 | 0.3 | 265 |
| Comparative Example 8 | 10.2 | 60.8 | 29.0 | 3.5 | 0.2 | 330 |

What is claimed is:

1. A coating material for a cathode-ray tube including a cathode ray tube envelope, an electron gun mounted in a neck portion of the envelope and a high voltage conductor mounted on a conical portion of the envelope, said electron gun being electrically connected to said conductor through a contactor of said electron gun and an electrically conductive coating film applied on the inner surface of said cathode-ray tube envelope, wherein said coating film has a specific resistance of at least 0.2 ohm.cm and a surface roughness of at least 6 microns, and a resistance value between said high-voltage conductor and said electron gun is in a range of 2 to 100 kohm, said coating material containing, in a weight ratio based on solid, 10 to 22% of graphite, 30 to 50% of a metal oxide, 2 to 9% of a surface treating agent and 25 to 42% of waterglass, and at least 18% of said graphite to be suspended in its simple form in said coating material having a particle size of at least 1 micron.

2. A coating material as defined in claim 1, wherein a part of said graphite is added in the form of a composite granulated powder with said metal oxide and surface treating agent, and another part of said graphite is added in the form of a powder in its simple form.

3. A coating material as defined in claim 1, wherein said metal oxide is titanium oxide, and said surface treating agent is silicon oxide.

* * * * *